US009185484B2

(12) United States Patent
Graber

(10) Patent No.: US 9,185,484 B2
(45) Date of Patent: Nov. 10, 2015

(54) HYDRODYNAMIC MODULATOR

(71) Applicant: Curtis E. Graber, Woodburn, IN (US)

(72) Inventor: Curtis E. Graber, Woodburn, IN (US)

( * ) Notice: Subject to any disclaimer, the term of this patent is extended or adjusted under 35 U.S.C. 154(b) by 346 days.

(21) Appl. No.: 13/742,755

(22) Filed: Jan. 16, 2013

(65) Prior Publication Data

US 2014/0198622 A1 Jul. 17, 2014

(51) Int. Cl.
*H04R 1/44* (2006.01)
*B06B 1/18* (2006.01)

(52) U.S. Cl.
CPC ... *H04R 1/44* (2013.01); *B06B 1/18* (2013.01)

(58) Field of Classification Search
CPC ..... E21B 43/00–43/003
USPC ..... 367/143; 166/249, 177.2
See application file for complete search history.

(56) References Cited

U.S. PATENT DOCUMENTS 3,169,013 A 2/1965 Jones
4,001,909 A * 1/1977 Erickson et al. ..... 15/105
4,675,194 A 6/1987 Gaffney
5,184,332 A 2/1993 Butler
5,837,272 A 11/1998 Fierro, Jr.
6,545,949 B1 4/2003 Franklin
2006/0108111 A1* 5/2006 Kas'yanov ..... 166/249
2009/0003123 A1 1/2009 Morrison, Jr.
2009/0241753 A1 10/2009 Mann

OTHER PUBLICATIONS

Young, A.M. and Henriquez, T.A., Underwater Helmholtz Resonator Transducers for Low Frequency, High Power Applications, Proceedings of the Institute of Acoustics, Apr. 1987, pp. 52-57, vol. 9, Part 2, University of Bath, Bath, United Kingdom.
Woollett, Ralph S., Underwater Helmholtz-Resonator Transducers: General Design Principles, Jul. 5, 1977, Naval Underwater Systems Center, New London, Connecticut.

* cited by examiner

*Primary Examiner* — Luke Ratcliffe
(74) *Attorney, Agent, or Firm* — Taylor IP, P.C.

(57) ABSTRACT

A hydraulic modulator provides a rectangular outlet from which water can be discharged across an outlet mouth. Spaced from the rectangular outlet across the outlet mouth is a rigid blade. Because water is effectively incompressible at the frequencies of interest a compliance chamber is provided along an interior side of the rigid blade. Mechanical compliance elements are provided within or adjacent to the compliance chamber which may be displaced to absorb and discharge mechanical energy from the flow of water. Water flow shifts back and forth relative to the interior and exterior sides of the rigid blade.

12 Claims, 6 Drawing Sheets

HYDRODYNAMIC MODULATOR

BACKGROUND

1. Technical Field

The field relates to modulation of water flow for the generation of sound.

2. Description of the Problem

Underwater Sound Sources Designed Around Helmholtz-Resonator Like configurations are known. Since water is substantially incompressible, the compliance function of a Helmholtz resonance chamber is implemented by adaptation of the resonance chamber into a "compliance chamber." This has been done by providing "compliance tubes" in the chambers among other techniques. Unlike what occurs where a compressible fluid/gas fills a resonance chamber, it is not chamber size which determines chamber compliance due to compressibility of the gas, but rather the compressibility of the compliance tubes. See Woollett, Ralph S.; *Underwater Helmholtz-Resonator Transducers: General Design Principles*; Naval Underwater Systems Center; NUSC Technical Report 5633 (5 Jul. 1977). Such systems have been designed using ceramic piezoelectric transducers as an excitation source to radiate sound at frequencies below 100 Hz even while the transducer operates at a much higher frequency. These devices function to provide a strong output peak at a Helmholtz like resonance, however, the greatest energy input is at the resonant frequency of the transducer.

Another technique for producing sound in liquids, in this case ultrasonic sound, has been the so-called underwater whistle. An example of such a system is described in Gaffney, U.S. Pat. No. 4,675,194. The '194 patent describes a device in which streams of liquids are directed through an orifice into a resonance chamber to impinge against a "vibratile element." Energy is transferred from the stream to the vibratile element which results in the vibratile element vibrating at ultrasonic frequencies. The vibratile element is constructed in the form of a blade which is positioned oriented parallel to and aimed into the directed streams of liquid. The sound generated by the blade promotes reactions between materials carried in the streams. A positive displacement pump is generally used to place the liquid under pressure for discharge. The jets of liquid from the orifice also shed vortices perpendicular to the direction of liquid flow and generate cavitation effects. Most underwater whistles appear to have been applied to promoting mixing of different materials through ultrasonic agitation.

SUMMARY

The hydraulic modulator of the present disclosure provides an inlet for connection to a pump which supplies water under pressure. A flow quieting and shaping section connects the inlet to a rectangular outlet from which water can be discharged in a flat stream exhibiting laminar flow. Parallel to and spaced from the rectangular outlet is a rigid blade. The rigid blade and the outlet define opposite sides of a mouth. A compliance chamber is provided along an interior side of the rigid blade adjacent to the mouth. The opposite side of the rigid blade is exposed to the ambient environment. The rigid blade operates to direct flow from rectangular outlet in an alternating fashion from side to side of the rigid blade, that is, between the compliance chamber and the environment. Rebound from the compliance chamber expels water from the compliance chamber when water is directed to the outside of the rigid blade.

Mechanical compliance elements are provided as part of, within or adjacent to the compliance chamber and allow the compliance chamber to supply the compressibility lacking in water to support resonance effects. The mechanical compliance elements absorb and discharge mechanical energy from the flow of water and allow a substantial portion of the flow of water to shift back and forth relative to interior and exterior sides of the rigid blade. The mechanical compliance elements may be tuned to select a resonant frequency. The position of the rigid blade may be changed in two-axes to change operating frequency or to change the operating pressure levels. Water flow rate may be changed to modify operating frequency or to adjust output amplitude.

BRIEF DESCRIPTION OF THE DRAWINGS

Understanding of the following description may be enhanced by reference to the accompanying drawings wherein.

DETAILED DESCRIPTION

Figure 1:
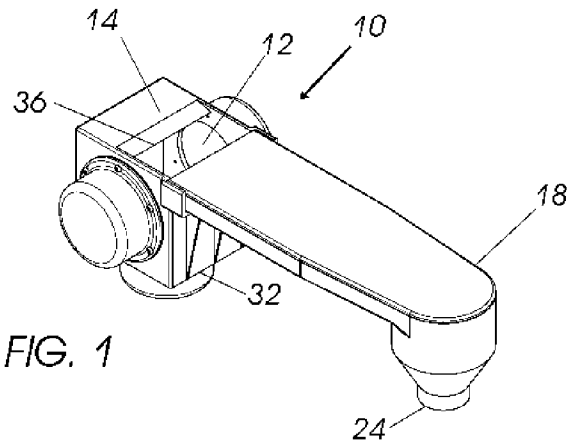
FIG. 1 is a top quarter perspective view of the hydrodynamic modulator of the present disclosure.
Figure 5:
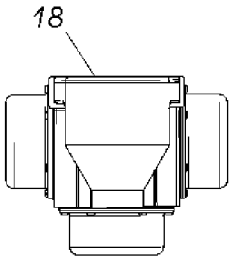
FIG. 5 is an end view of the hydrodynamic modulator taken from an inlet end.
Figure 2:
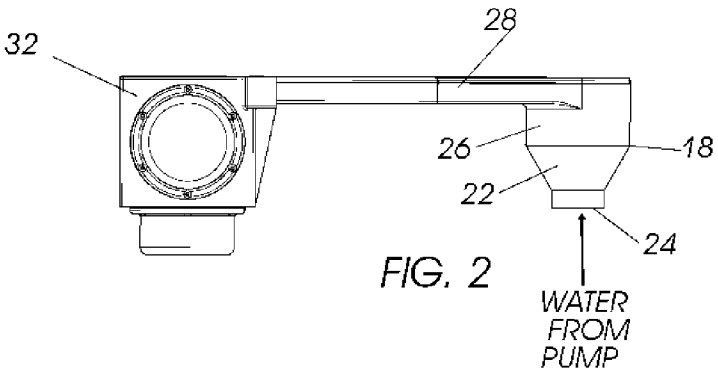
FIG. 2 is a side view of the hydrodynamic modulator.
Figure 3:
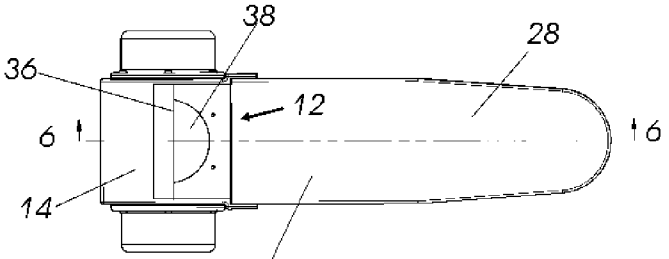
FIG. 3 is a top view of the hydrodynamic modulator.
Figure 4:
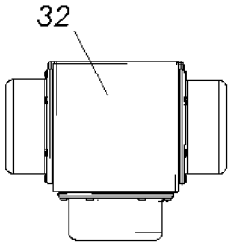
FIG. 4 is an end view of the hydrodynamic modulator taken from the end of a modulator compliance chamber.

A hydrodynamic modulator 10 is shown in FIGS. 1 and 2. Hydrodynamic modulator 10 operates to produce sound at a selected frequency in water from an input stream of water supplied by a pump (not shown) while submerged in water. The embodiment illustrated in FIGS. 1-8 is particularly adapted for the generation of infrasound, however, the general concepts disclosed here are not limited to low frequency devices.

Referring to FIGS. 1-5, hydrodynamic modulator 10 may be connected to receive water from a pump through an inlet 24. Water flows through a flow quieting section 18 and out through a rectangular outlet 34 across a mouth 12 in a stream. Spaced from outlet 34 across the mouth 12 and oriented into the stream is a rigid blade 14. Rigid blade 14 operates as a kind of flow control valve for the water stream. As long as the stream of water is ejected from rectangular outlet 34 exhibiting laminar flow and at a constant pressure. The stream shifts from side to side of rigid blade 14 at a frequency fixed by position of the blade, the rate of flow of water from the outlet, the depth of the hydrodynamic modulator 10, available compliance and its selected spring rate and area of the mouth 12.

Because water resists compression an enclosure (compliance chamber 33) is located adjacent to the mouth 12 and along one side (hereafter the "interior side") of the rigid blade 14. The only outlet from compliance chamber 33 is mouth 12.

The compliance chamber 33 functions analogously to a resonance chamber in an air whistle by providing mechanical compliance which absorbs and discharges mechanical energy due the flow of water. In contrast to an air whistle, resonance chamber compliance is provided by mechanical elements within the compliance chamber 33 or built into the walls of the compliance chamber. The resonant frequency of the compliance chamber 33 can be adjusted by varying the size of mouth 12 and by changing the compliance of the mechanical compliance elements of the chamber.

Embodiments of hydrodynamic modulator 10 have been built to operate at frequencies from 3 Hz to 12,000 Hz. It is believed that sub 1 Hz frequencies are possible given sufficient compliance from an air column. In high frequency embodiments resonance has been achieved just by making one of the interior walls of the compliance chamber 33 thinner and more compliant than the other, stiffer walls. A small, highly tuned compliance chamber where compliance is built into the walls of the cavity may allow pushing the upper frequency limit into the ultrasonic range. Operational frequency can also be adjusted by changing the area of the mouth 12. Increases in the area of the mouth 12 allow for the passage of greater masses of water in and out of compliance chamber 33 and reduces the device's operating frequency while reducing the area correspondingly increases the operating frequency. The primary minimum limits on size of the compliance chamber are that it have sufficient capacity for the amount of water passed with each half cycle.

The hydrodynamic modulator 10 includes a flow quieting section 18 in which the flow of water received through the inlet 24 is stabilized leading to laminar flow discharge of the water from a rectangular/slit outlet 34 and into and across mouth 12. The long axis of the rectangular outlet 34 is parallel to the plane of mouth 12. The flow quieting section 18 comprises, in upstream to downstream order, the inlet 24, an upstream expansion zone 22 in the form of an inverted cone with its circular sections perpendicular to the direction of flow of water, a cylindrical upstream planar or flow calming zone 26 immediately downstream from the upstream expansion zone 22, a trapezoidal downstream expansion zone 28 having a rectangular cross section and lastly a downstream planar zone 30 defining a laminar flow conduit 42 (see FIG. 7) having fixed dimensions along its length which steadies flow for laminar discharge from the rectangular outlet 34. While flow quieting section 18 has multiple stages, a system having a single stage of calming area coupled to the slit nozzle would save space at the expense of some loss in laminar flow from the stream.

Rigid blade 14 is beveled to a labium lip 36 parallel and adjacent to the edge of mouth 12 opposite the rectangular outlet 34. Labium lip 36 is formed in rigid blade 14 by beveling the outside surface of the blade to a leading edge. A relatively small angle produces better results than blunter angles with an optimum angle being between 10 to 15 degrees. As an alternative the blade could simply be made thinner and rigidity maintained using carbon fiber construction. Beveling could then be dispensed with, however there would likely be a loss of efficiency.

The hydrodynamic modulator 10 is conceptually divided into a second major section based around a resonance assembly 32 located adjacent to mouth 12. Resonance assembly 32 encloses a compliance chamber 33 and provides three compliance control volumes 40, two to the sides of the compliance chamber and one at the bottom. The top face of the resonance assembly 32 is partially open to the environment through the mouth 12 adjacent the rectangular outlet 34. The top face is partially closed by a rigid blade 14 which is located co-planar to the upper portion 44 (see FIG. 8) of the flow adaptor section 18 but distal to the rectangular outlet 34. Dropping rectangular slot 34 deeper into the compliance chamber relative to the rigid blade 14 increases the maximum pressure the device will modulate at while also increasing the on-set threshold pressure of initial operation.

Figure 7:
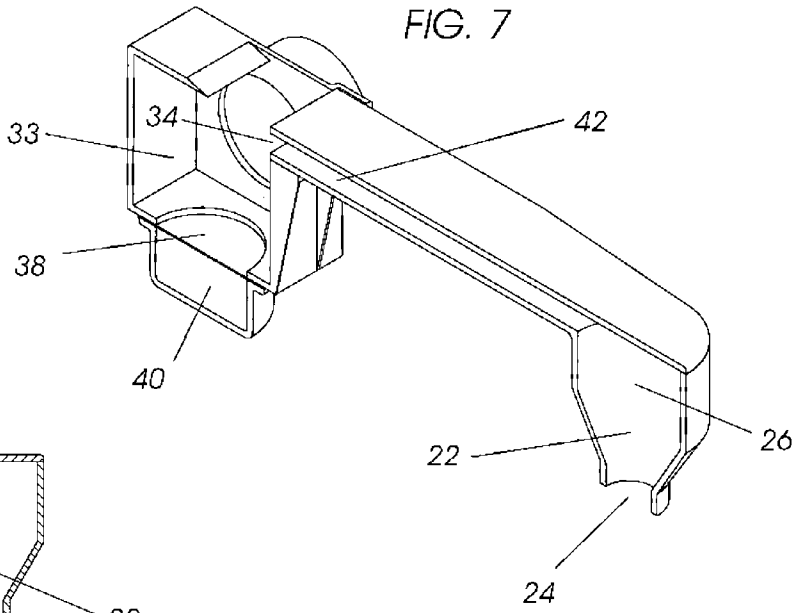
FIG. 7 is a cut-away perspective view taken along section line 6-6 of FIG. 3.
Figure 8:
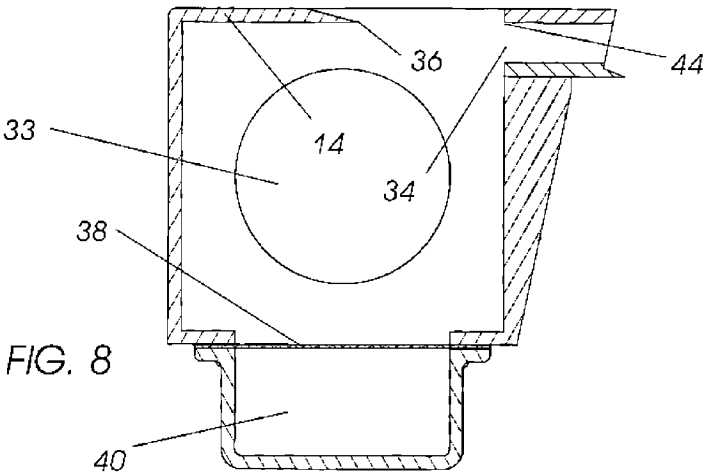
FIG. 8 is a detail view of the compliance chamber of the hydrodynamic modulator from the section marked with "8" of FIG. 6.
Figure 6:
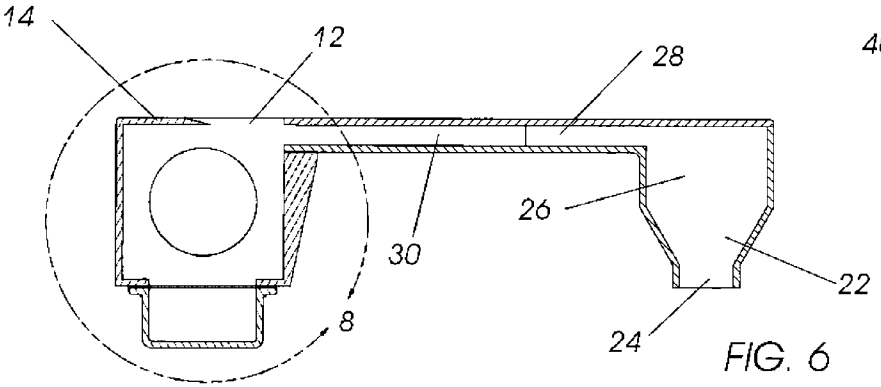
FIG. 6 is a cross-sectional view of the hydrodynamic modulator taken along section line 6-6 of FIG. 3.

As shown in FIGS. 6-8, compliance chamber 33 is located within resonance assembly 32 and is roughly cube shaped although its shape is not critical. The enclosed volume is open to the environment along mouth 12. There are a number of ways the compliance parameters of compliance chamber 33 can be varied. Woollett, for example, described the use of "compliant tubes." A compressible foam or rubber mechanism which could be positioned in the interior of a compliance chamber. Such elements could be used here mounted along corners of the compliance chamber 33. The object of the compliance mechanism used, be it a compliance tube or, as here, a compliance diaphragm 38 is to provide the capacity to absorb mechanical energy that the water filling the compliance chamber 33. In the present device it is intended that water flow shift from side to side of the rigid blade 14 at or close to the resonant frequency of the compliance chamber 33 in a fashion analogous to the operation of an air whistle. In contrast to air in an air whistle, the working fluid in hydrodynamic modulator 10 is a substantially incompressible liquid and at low frequencies water will escape from mouth 12 rather than absorb significant mechanical energy through its compression in the compliance chamber 33.

The primary mechanisms of the present embodiment for establishing values for compliance parameters are an elastic compliance diaphragm 38 located in one side of the resonant assembly 32 and a compliance control volume 40 which backs the compliance diaphragm 38 on the side opposite to the side of the diaphragm exposed to the compliance chamber 33. The compliance volume 40 is filled with gas, which may be air. Pressure may be adjusted in the compliance volume to maintain balance in forces on both sides of the compliance diaphragm and thus maintain a constant strain across the compliance diaphragm with changes in depth under water of the hydrodynamic modulator 10. The gas in compliance control volume 40 is compressible and as a result the elastic compliance diaphragm 38 and the air can absorb mechanical energy from and release mechanical energy to water flowing into the compliance chamber 33 and out of the mouth 12.

The compliance control volume 40 can be replaced with a number of structures including, for example, a compression spring or other mechanisms for adjustment of its operating parameters could be included such as a variable displacement piston which could be used to adjust the neutral volume of the compliance control volume 40. Compliance diaphragm 38 may even be left open to the environment on the side not lining the compliance chamber 33. The volume of the compliance chamber 33, as long as sufficient to keep the area around rigid blade 14 free of obstructions, is not particularly important. In another case, if air can be trapped in a compliance control volume 40 it is possible to dispense with compliance diaphragm 38. One or more simple trapped air bubbles can function as the mechanical compliance element. The compliance increases with increases in the spring constant of the compliance control/tuning volume 40. It also depends upon the elastic properties of the compliance diaphragm 38, if present, the compressibility of the liquid in compliance chamber 33, which is usually so small as to be of no consequence, and potentially on the stiffness of the compliance chamber 33 walls.

In operation water ejected from outlet 34 has a rectangular prism section. The flow is laminar and is directed across mouth 12 onto a labium lip 36 for a rigid blade 14. The flow of water alternates from front to back sides of the rigid blade 36. This alternation of sides occurs at a frequency determined and steadied by parameters of a compliance chamber 33. Output frequency of pulses of water discharged from mouth 12 varies with flow and the values of the compliance chamber parameters.

Lowering the rectangular outlet 34 deeper into the compliance chamber 33 in relationship to the rigid blade 36 increases the maximum pressure the device will modulate at the cost of increasing the on-set threshold pressure for initial operation. In order to run the modulator 10 at highest pressure the outlet 34 is often significantly lower than the blade 36. Conversely, a unit can be built to work at very low pressure using an outlet 34 height that is nearly centered on the edge of the blade. If rigid blade 14 is made positionable, including the ability to move into and out of the compliance chamber 33, and back and forth relative to outlet 34, the hydrodynamic modulator 10 can be provided with the ability to change operating frequency and output amplitude.

Modulators have been built to produce selected fixed frequencies from 3 Hz to 12,000 Hz. However operation at below 1 Hz and the use of much smaller, highly tuned compliance chambers to produce the fixed frequency in the ultrasonic region are believed to be possible. In high frequency versions adequate compliance was achieved by thinning out one of the interior walls of the chamber to give it some flex. Backing of the wall using an air column was not necessary.

Nor is it strictly necessary to use a four stage flow calming conduit. A single stage calming area coupled to the outlet which would save space. A narrow bevel angle for the edge of blade 12 has been found to produce better results than thicker, blunter angles. An optimum angle appears to be between 10-15 degrees. It is possible to use a blade with no bevel if sufficiently narrow and rigid. A thin wall section of stiff carbon fiber for instance might work.

Hydrodynamic modulator 10 operates in a manner analogous to common weight and spring oscillator. The water in motion moving between the interior cavity and the external area is the mass, the diaphragm flexural q or compliance is the number of spring coils allowing for excursion of the weight in its oscillation, and the volume of air behind the diaphragm is the spring tension rate. Larger volumes of air behind the diaphragm tend to tune the mass to lower frequency, tighter less flexible diaphragm materials tend to shift the frequency limitations up based upon limiting excursion of the masses oscillation. Larger aperture mouth areas (item 12) tend to increase the mass of the moving fluids and move the frequency lower, increased flow/pressure tends to increase the frequency of the device.

Figure 9:
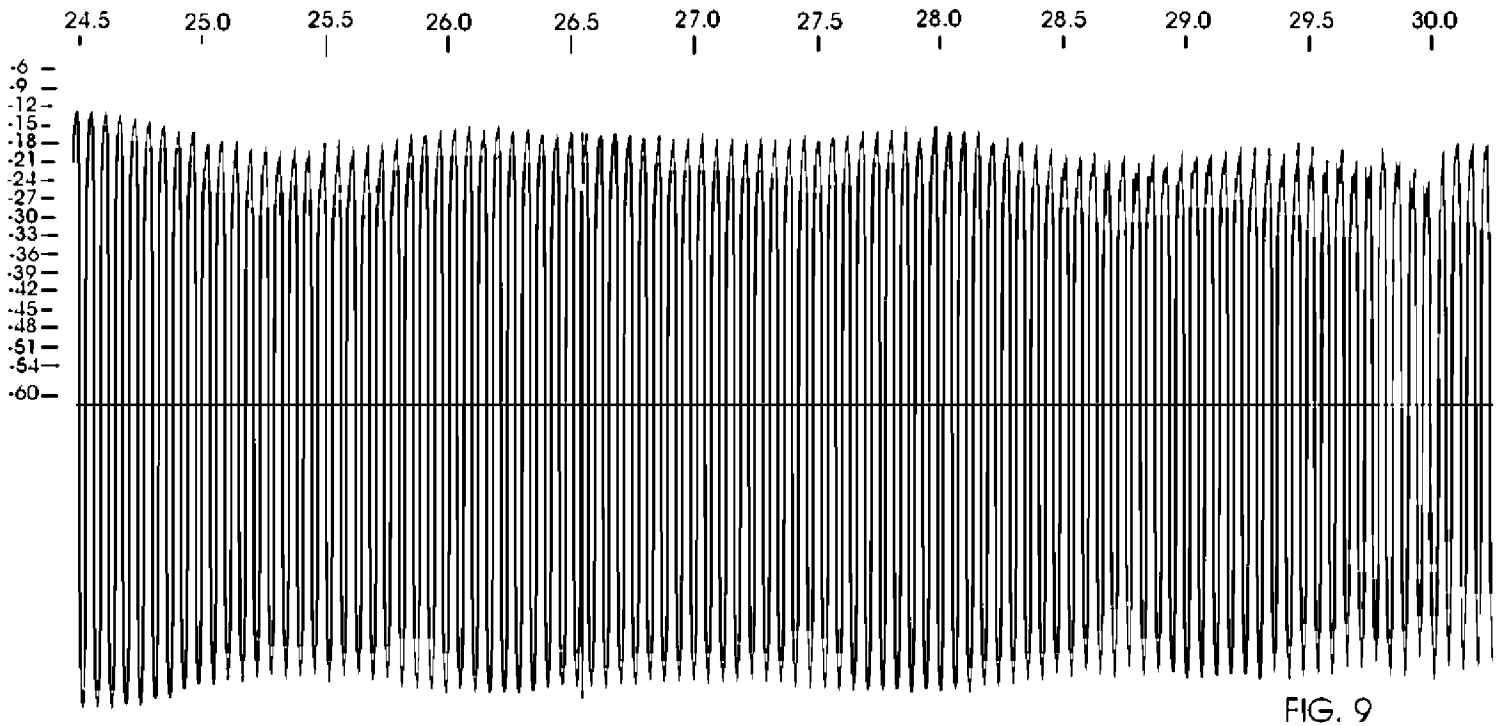
FIG. 9 is a graph of signal intensity versus time at the resonant frequency.
Figure 10:
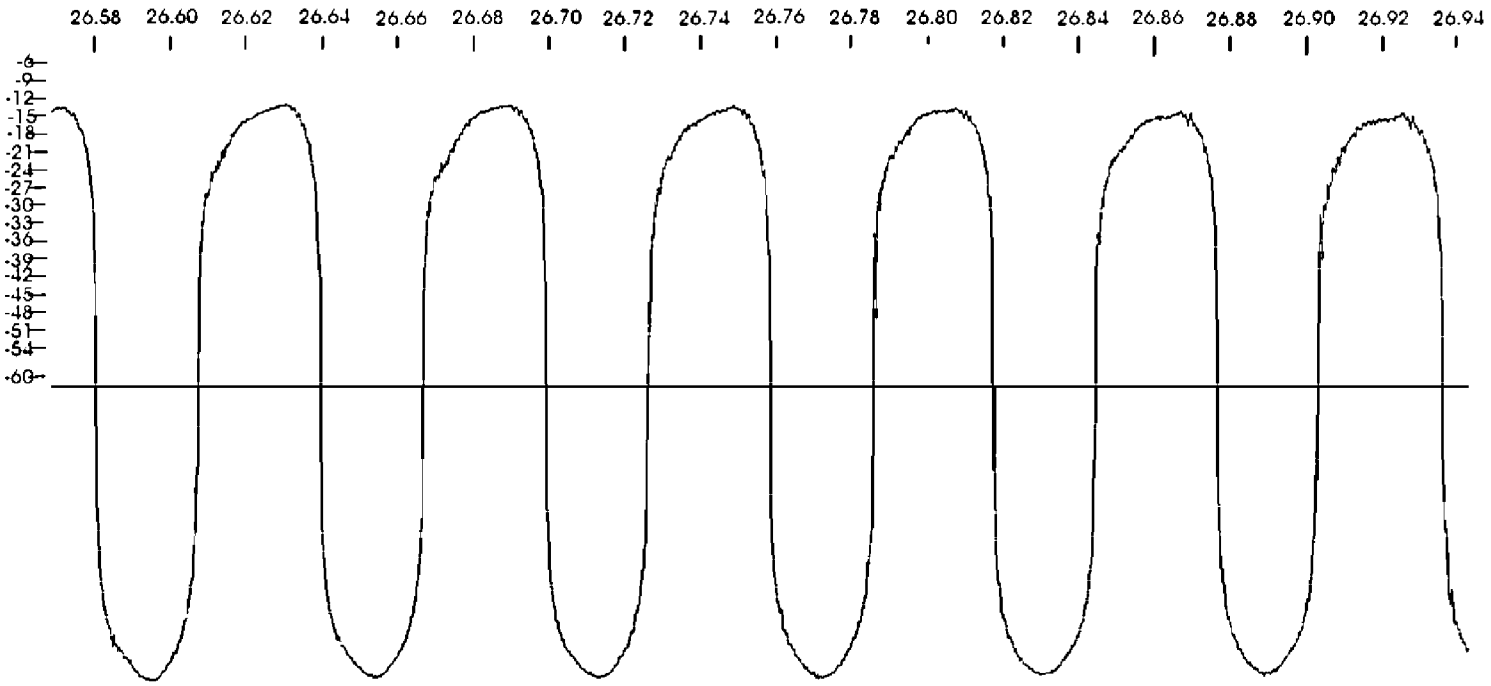
FIG. 10 is a graph of signal intensity versus time at a resonant frequency.
Figure 11:
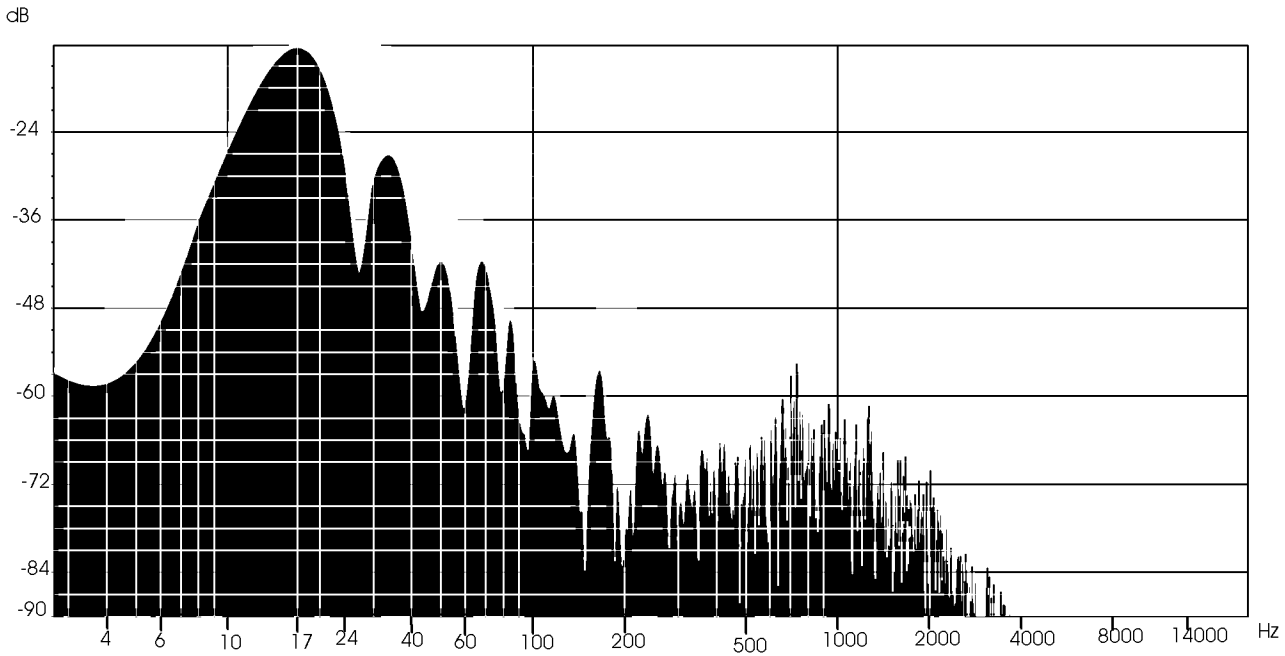
FIG. 11 is a frequency spectrum.

FIGS. 9-11 are graphs illustrating test data relating to operation of a representative device. Here a hydrodynamic modulator 10 is operating in infrasound (18 Hz) as shown in FIGS. 9 and 10. The spectrum graph (FIG. 11) shows a large primary hump in output centered at 18 Hz. The parameters of the hydrodyamic modulator 18 and its operation include a flow rate of 160 gallons per minute at 23 psi from outlet 34 at a depth of 1 to 3 feet. Sound intensity is 148 dB providing 3 cubic inches of volumetric water displacement with each cycle. The spring constant is 625.5 N/m. The area of the mouth 12 is 19.25 square inches. A particular spectrum is valid for a particular depth. Here the depth is in the area of a couple of feet. If depth is increased the operating frequency increases up to a limit. Increasing depth functions to increase the spring constant in hydrodynamic modulator 10. However, at some depth the device will simply cease functioning.

Figure 12:
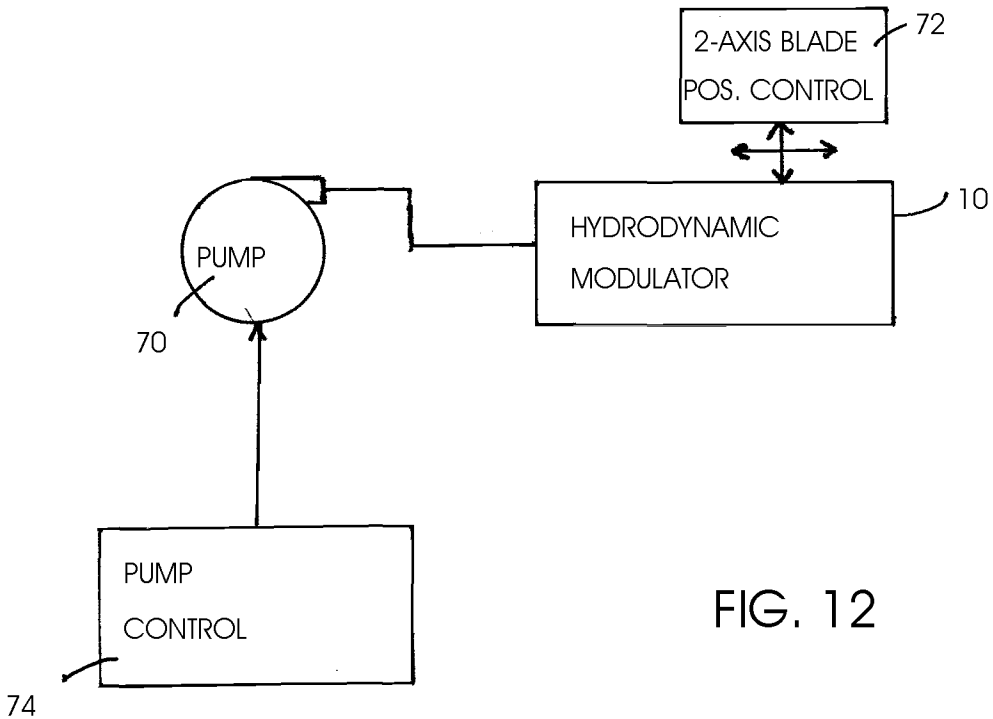
FIG. 12 is a block diagram of a control system for the hydrodynamic modulator.

Referring to FIG. 12, a block control diagram illustrates incorporation of two-axis positional control 72 for rigid blade 14 in hydrodynamic modulator 10. Rigid blade 14 may be moved to change the spacing across mouth 12 or to adjust the relative alignment of the blade relative to rectangular outlet 34. In addition, the operating speed of a pump 70 which provides water to hydrodynamic modulator 10 may be changed using a pump controller 74.

What is claimed is:

1. An hydraulic modulator comprising:

a flow quieting and shaping section including an inlet for connection to a source of water under pressure;

a laminar flow outlet from the flow quieting and shaping section;

a rigid flow control blade located spaced from the laminar flow outlet and aligned parallel to the direction of flow of fluid discharged from the laminar flow outlet;

a compliance chamber along and defining an interior side of the rigid blade; and at a least a first mechanical compliance element located within or adjacent to the compliance chamber, the mechanical compliance element including:

a displaceable section in a wall of the compliance chamber; and a spring supporting the displaceable section, the spring being a gas filled cavity adjacent the compliance chamber, and the displaceable section being an elastic diaphragm dividing the compliance chamber from the gas filled cavity.

2. The hydraulic modulator of claim 1, the mechanical compliance elements including compressible members located in the compliance chamber.

3. The hydraulic modulator of claim 1, the mechanical compliance elements including an elastic diaphragm open to the environment on one side.

4. The hydraulic modulator of claim 1, the flow quieting and shaping section including an upstream section including a circularly cross sectionally shaped expansion and holding section and a downstream rectangularly shaped discharge section.

5. An hydraulic modulator comprising:

means for shaping a water stream into a rectangular cross section with substantially laminar flow characteristics;

a mouth across which the means for shaping directs a water stream;

a compliance chamber located along one side of the mouth;

a flow control structure forming a side of the mouth opposite the means for shaping for directing the water stream into and out of the compliance chamber in an alternating fashion;

means for varying the compliance of the compliance chamber including a gas filled volume located along a side of the compliance chamber and a displaceable barrier separating the compliance chamber from the gas filled volume.

6. The hydraulic modulator of claim 5, further comprising: the flow control structure being a beveled rigid blade positioned parallel to the water stream.

7. The hydraulic modulator of claim 6, further comprising: the displaceable barrier being an elastic diaphragm.

8. The hydraulic modulator of claim 7, further comprising: means for varying gas pressure in the gas filled volume at a static displacement of the displaceable barrier.

9. The hydraulic modulator of claim 6, further comprising: the beveled rigid blade forming a wall of the compliance chamber.

10. The hydraulic modulator of claim 5, further comprising: means for adjusting position of the rigid blade to change operating frequency or to change potential operating pressure levels.

11. The hydraulic modulator of claim 10, further comprising:

a water pump; and means for changing water pump operating speed.

12. The hydraulic modulator of claim 5, further comprising:

a water pump; and means for changing water pump operating speed.

* * * * *